United States Patent [19]

Conversy

[11] Patent Number: 5,028,168

[45] Date of Patent: Jul. 2, 1991

[54] DEVICE FOR THE INTERCONNECTION OF TWO ROADWAY PARTS SEPARATED BY AN EXPANSION JOINT

[76] Inventor: Francois Conversy, 191 Boulevard Péreire, 75017 Paris, France

[21] Appl. No.: 460,127

[22] PCT Filed: Sep. 27, 1989

[86] PCT No.: PCT FR89/00493

§ 371 Date: May 22, 1990

§ 102(e) Date: May 22, 1990

[87] PCT Pub. No.: WO90/03469

PCT Pub. Date: Apr. 5, 1990

[30] Foreign Application Priority Data

Sep. 30, 1988 [FR] France ..... 88 12818

[51] Int. Cl.[5] ..... E01C 11/12

[52] U.S. Cl. ..... 404/68; 404/47; 404/69

[58] Field of Search ..... 404/47, 68, 69, 57, 404/56

[56] References Cited

U.S. PATENT DOCUMENTS

| | | | |
|---|---|---|---|
| 3,829,229 | 8/1974 | Britton et al. | 404/69 |
| 3,854,159 | 12/1974 | McLean et al. | 404/47 |
| 4,030,156 | 6/1977 | Raymond | 404/69 |
| 4,131,382 | 12/1978 | Hymo | 404/69 |
| 4,132,491 | 1/1979 | Scheffel | 404/68 |
| 4,833,851 | 5/1989 | Ohmatsu | 404/56 |

FOREIGN PATENT DOCUMENTS

| | | |
|---|---|---|
| 0015667 | 9/1980 | European Pat. Off. . |
| 2330640 | 1/1974 | Fed. Rep. of Germany . |
| 2228895 | 12/1974 | France . |

*Primary Examiner*—Ramon S. Britts
*Assistant Examiner*—Nancy P. Connolly
*Attorney, Agent, or Firm*—Young & Thompson

[57] ABSTRACT

The device for the interconnection of two roadway parts (1*a*, 1*b*) separated by an expansion joint (3) consists of a plurality of joint strips (2) arranged end to end and in which each joint strip (2) comprises at least one deformable zone (4) extending parallel to the joint (3), between two fastening elements (5*a* and 5*b*) connected to the two roadways parts (1*a*, 1*b*), respectively. The deformable zone (4) consists of alternating deformable carrying elements (6) and bellows (7). Two undeformable carrying elements (18) belonging to the fastening elements (5*a*, 5*b*), respectively, are situated on either side of each bellows (7). Each of the deformable carrying elements (6) has a horizontal metal plate situated in the upper part of the joint strip (2) and carried by two elastomer blocks which are deformable by horizontal shearing and arranged symmetrically relative to a vertical plane parallel to the joint (3). Each of the bellows (6) consists of an elastomeric, continuous, relatively thin and non-plane wall.

Use in order to improve the travel of vehicles over roadway joints.

11 Claims, 11 Drawing Sheets

Figure 1:
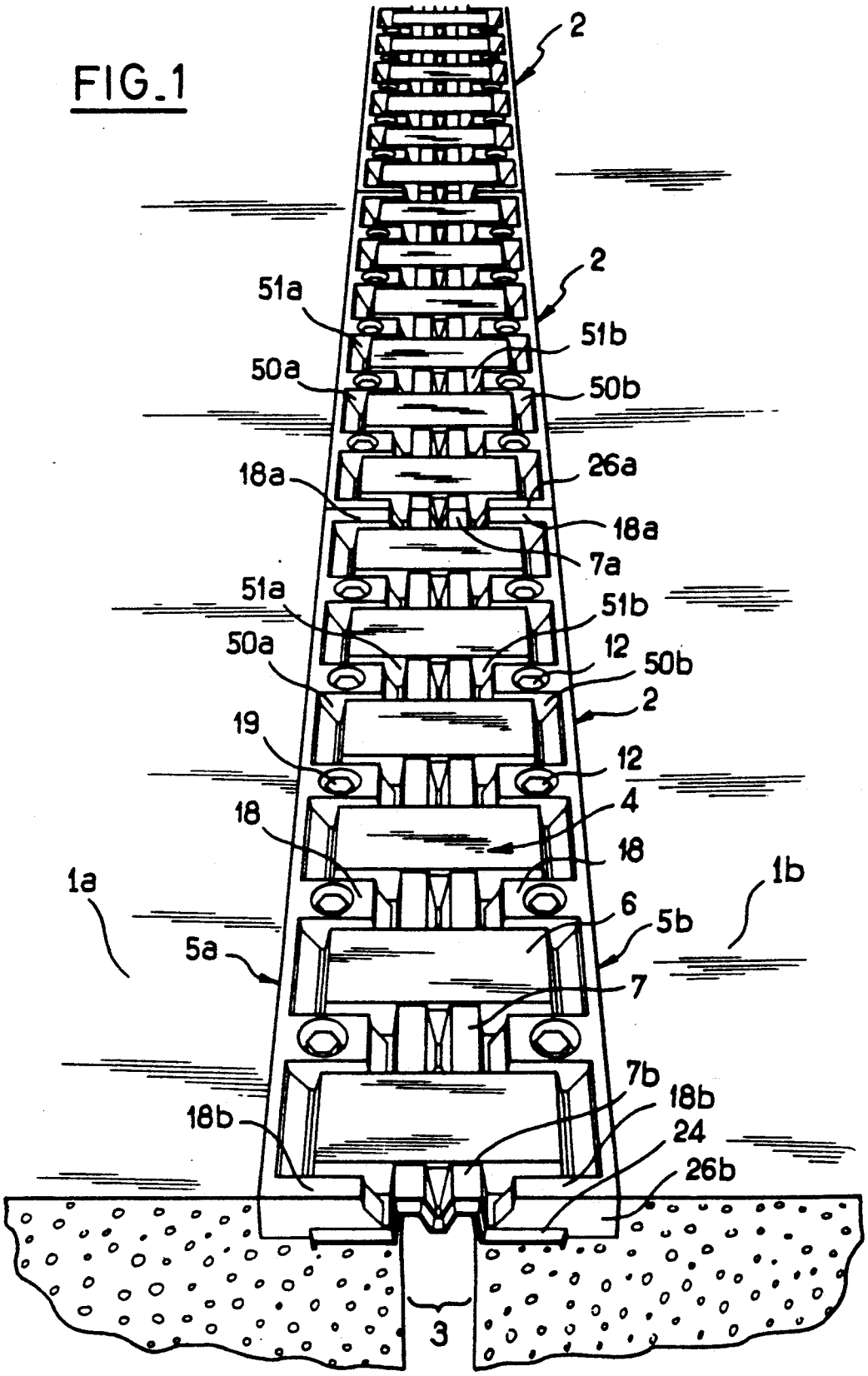

DEVICE FOR THE INTERCONNECTION OF TWO ROADWAY PARTS SEPARATED BY AN EXPANSION JOINT

The present invention relates to a device for the interconnection of two roadway parts separated by an expansion joint, such as exists in bridges or other engineering works.

This device is intended to ensure the tightness of the joint whilst at the same time providing satisfactory travelling conditions for vehicles.

In a known embodiment, devices of this type have a plurality of joint strips arranged end to end above the joint, each of the said joint strips being in the form of an elastomeric molded piece in which metal pieces are included.

In order to allow the movements of the expansion joint whilst at the same time ensuring tightness, the known joint strips, consisting of a plurality of identical joint strips arranged end to end and each of which is an elastomeric molded piece, have an upper face which is in the form of a substantially plane surface in which rectilinear recesses, parallel to the joint, are provided.

This arrangement has the following disadvantages:

When the joint is placed perpendicular to the trajectory of the vehicles, the passage of the wheels over these recesses is felt as a shock by the passengers in the vehicles, which has an adverse effect on their width, in other words when the joint is maximally open.

When the joint is placed parallel to the trajectory of the vehicles, these recesses constitute a real danger for bicycles and motorcycles as they may cause them to fall.

The invention aims to overcome these disadvantages by providing a device consisting of joint strips without rectilinear recesses parallel to the joint and with a manufacturing cost less than that of the known devices.

The device for the interconnection of two roadway parts separated by an expansion joint, which is the subject of the invention, consists of a plurality of joint strips arranged end to end. Each joint strip comprises at least one deformable zone extending parallel to the joint, between two fastening elements connected to the two roadways parts respectively.

According to the invention, this device for the interconnection of two roadway parts is characterized in that this deformable zone consists of alternating carrying elements and bellows, which are deformable in all horizontal directions, the length of the bellows, measured in the direction perpendicular to the joint, being less than that of the deformable carrying elements, and in that, on either side of each bellows, two undeformable carrying elements are situated, these undeformable carrying elements extending in a direction transverse to the joint in the space between two deformable carrying elements. Each of the deformable carrying elements has a horizontal metal plate situated in the upper part of the joint strip and carried by two elastomer blocks, deformable by horizontal shearing and arranged symmetrically relative to a vertical plane parallel to the joint. Each of the bellows consists of an elastomeric, continuous, relatively thin and non-plane wall. A deformable zone thus comprises alternating bellows between deformable carrying elements (which support the load of the vehicles). Because the bellows are not as long, in the direction perpendicular to the joint, as the deformable carrying elements, the interconnection of a deformable zone and the elements which are adjacent to it does not have a rectilinear recess parallel to the expansion joint.

The shock generated during the passage of vehicle wheels, or the danger of a fall for cyclists and motorcyclists are thus limited.

According to a preferred version of the invention, the interconnection of a deformable zone, consisting of alternating bellows and deformable carrying elements, and each of the elements which is adjacent to it consists of a recess with a crenellated shape. This crenellated recess permits the deformation of the bellows and of the deformable carrying elements without creating any substantial shock during the passage of the wheels or any danger for the cyclists and motorcyclists.

Other features and advantages of the present invention will further emerge from the description hereinbelow.

Figure 2:
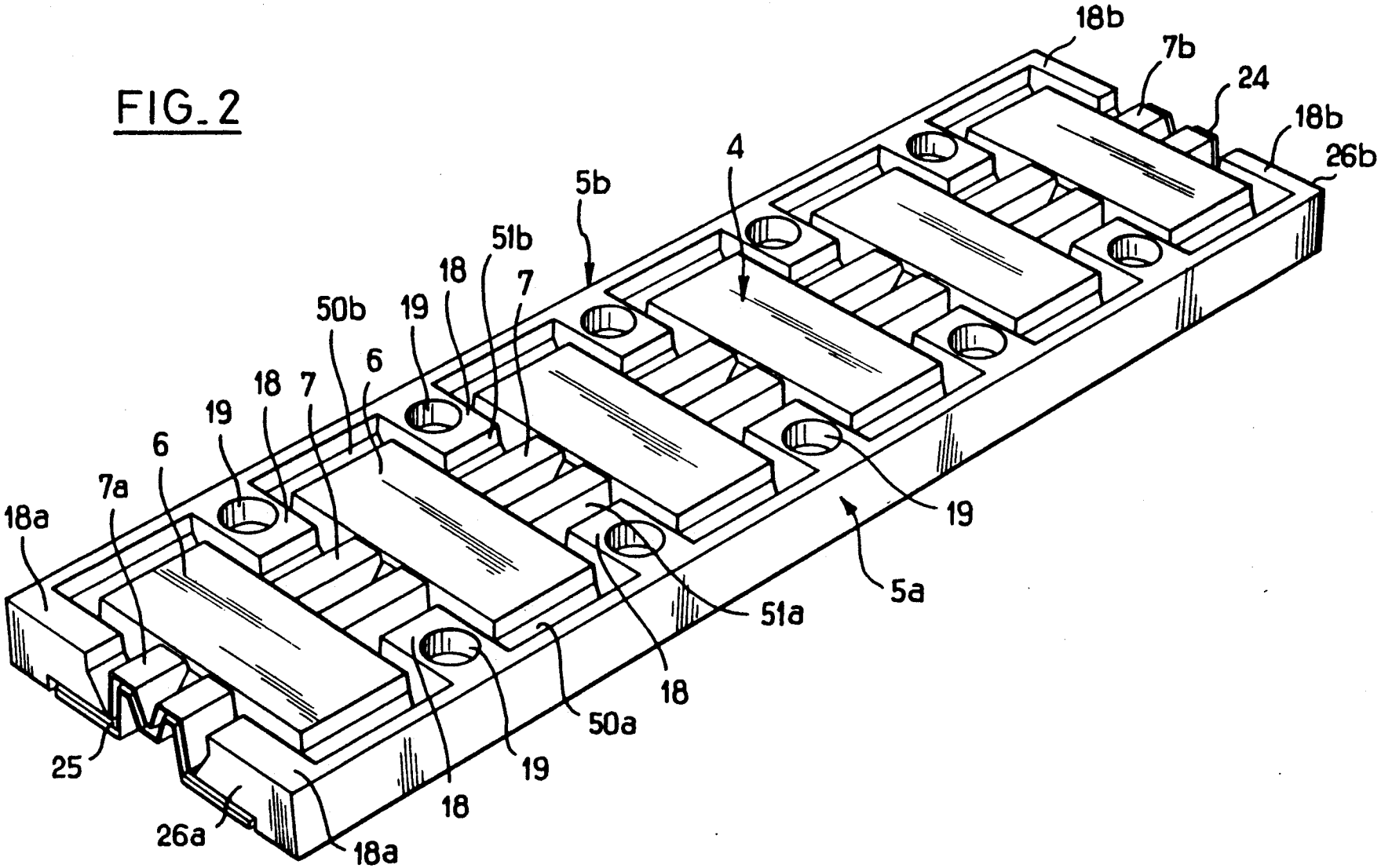
Figure 3:
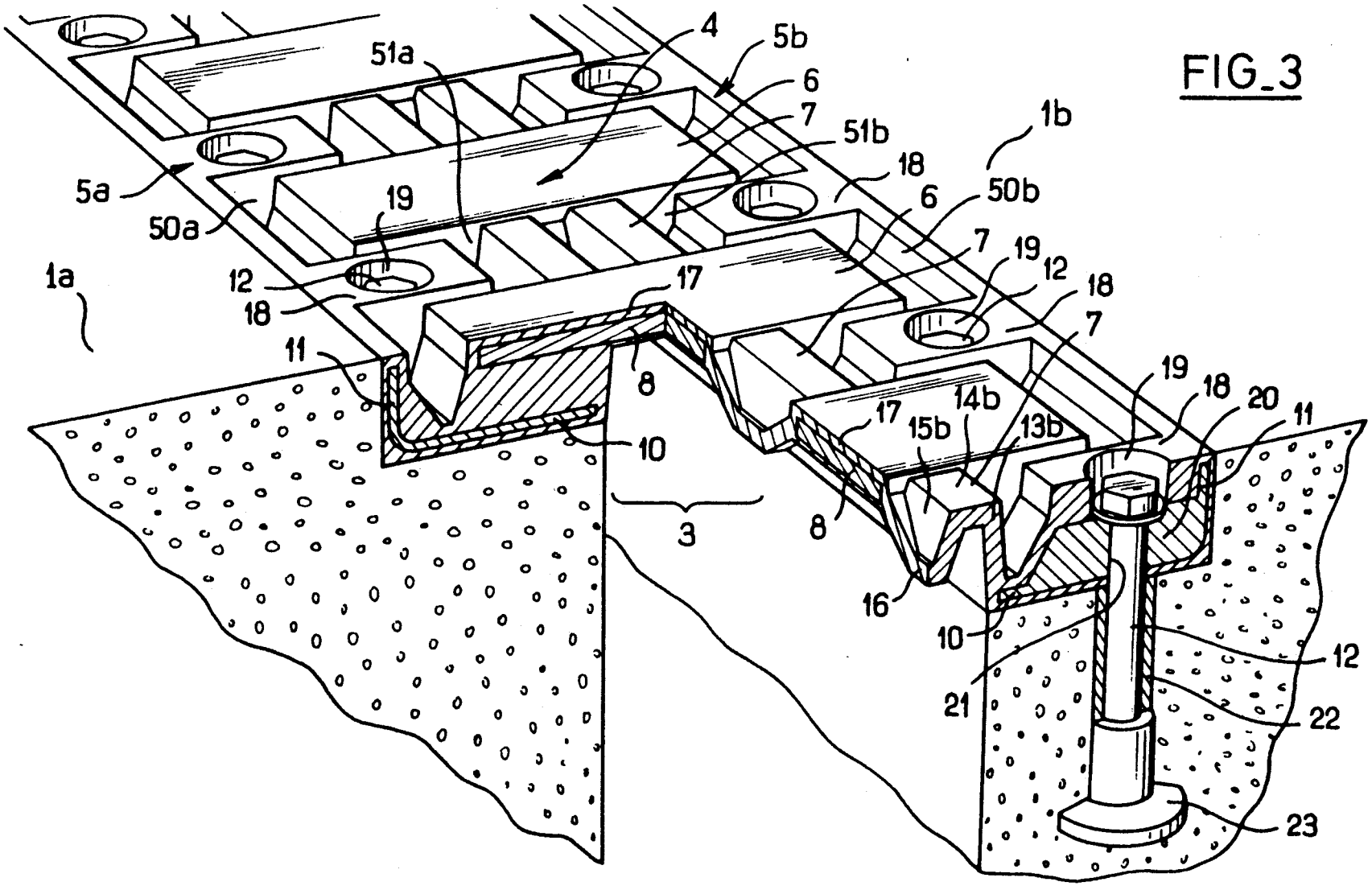
Figure 4:
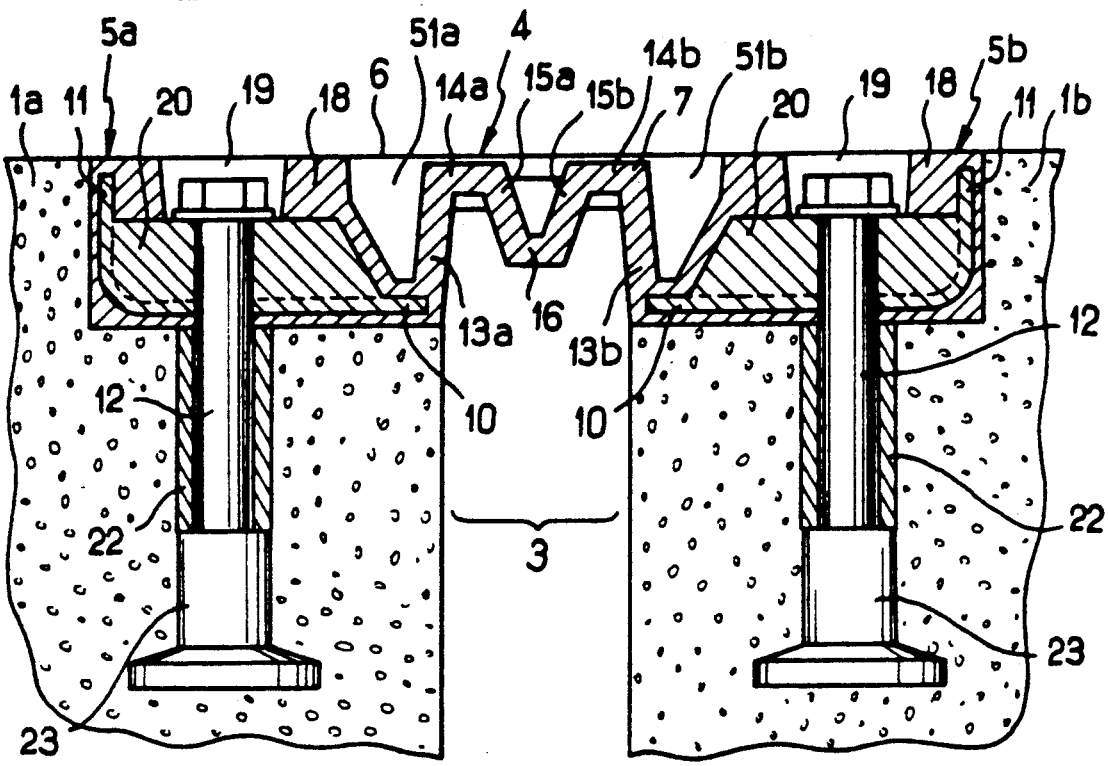
Figure 5:
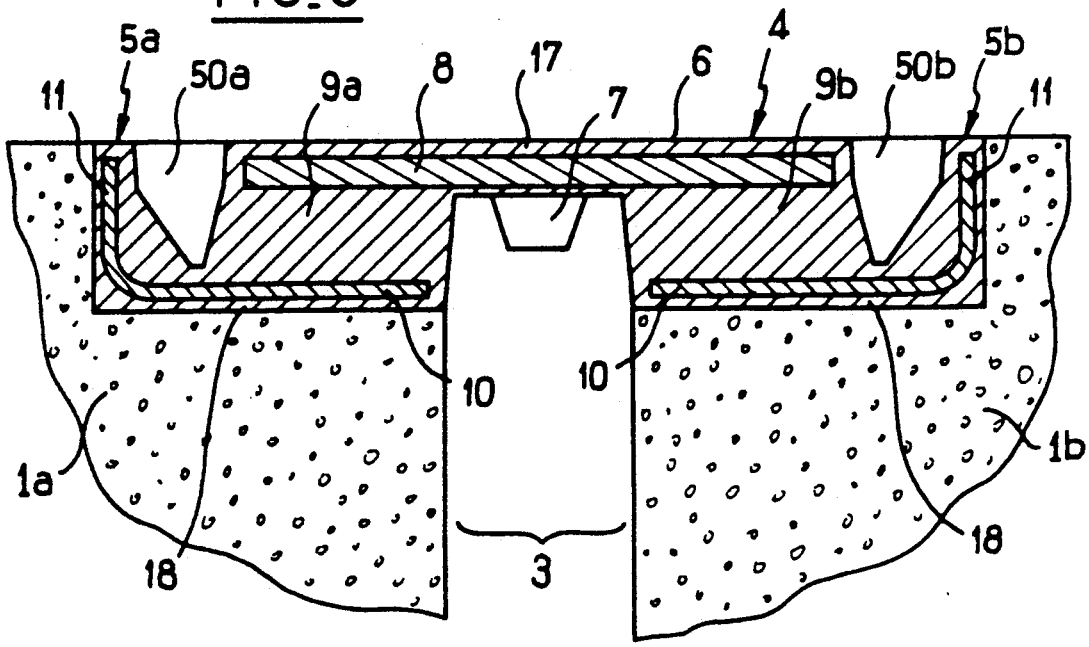
Figure 6:
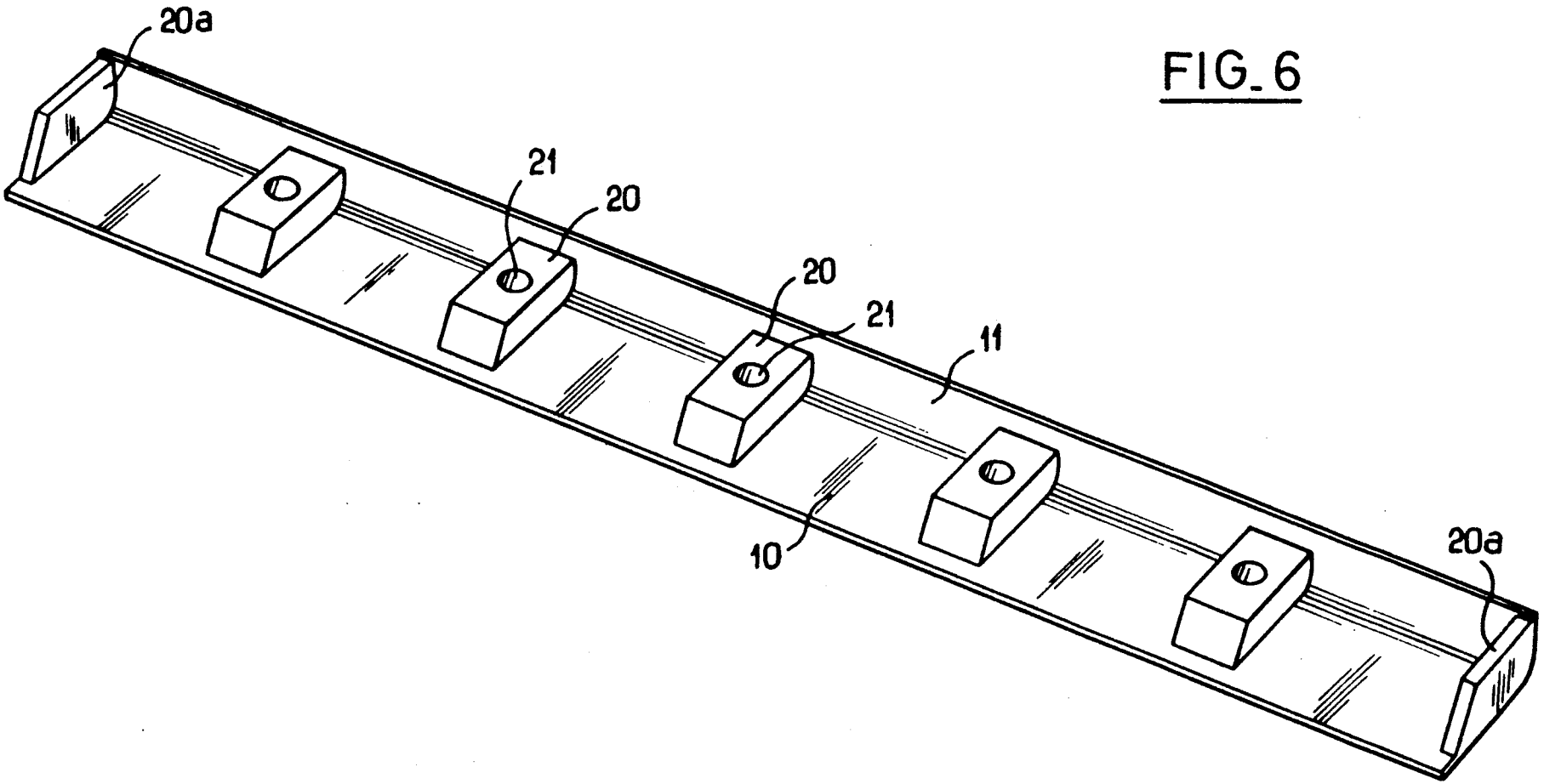
Figure 7:
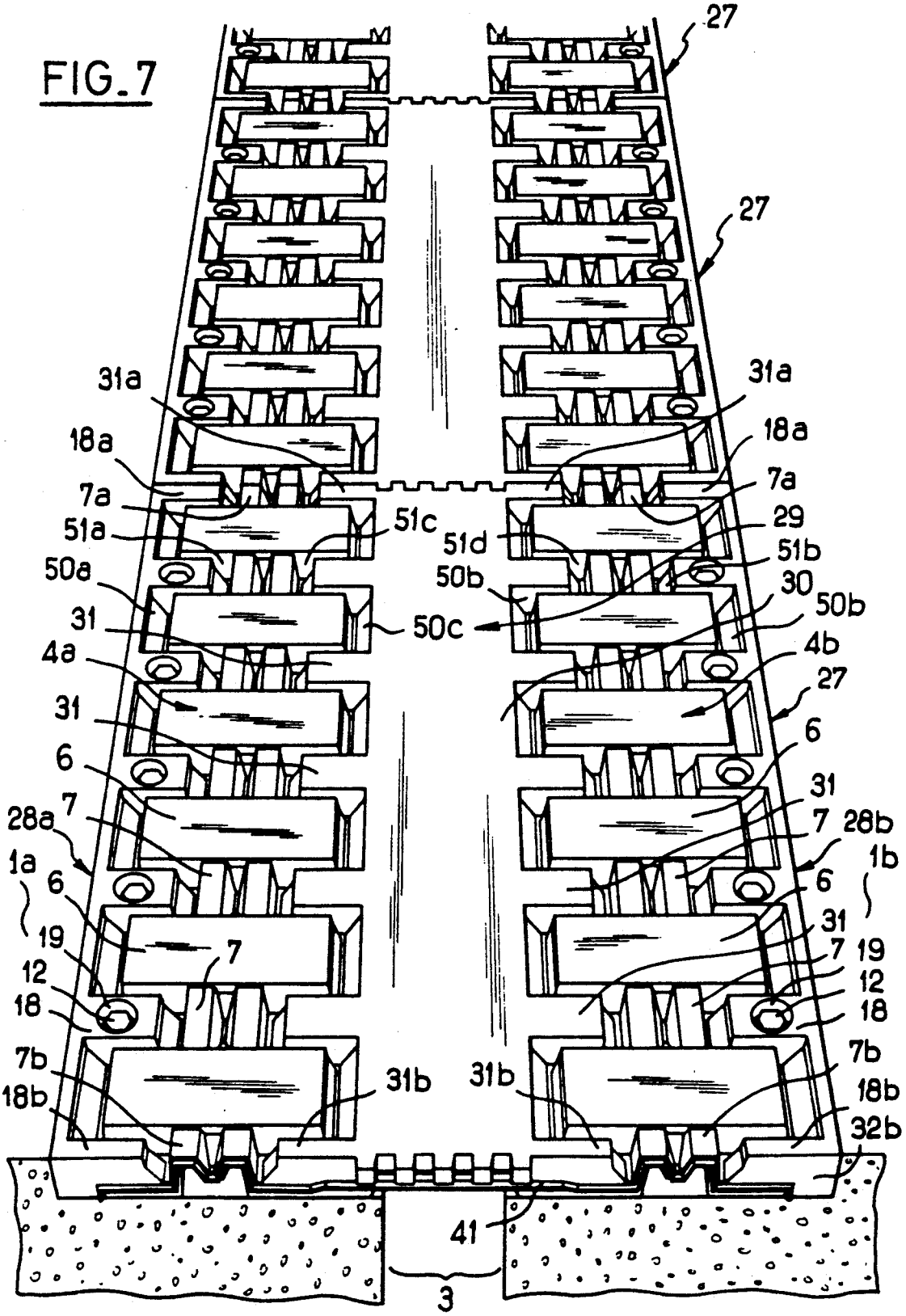
Figure 8:
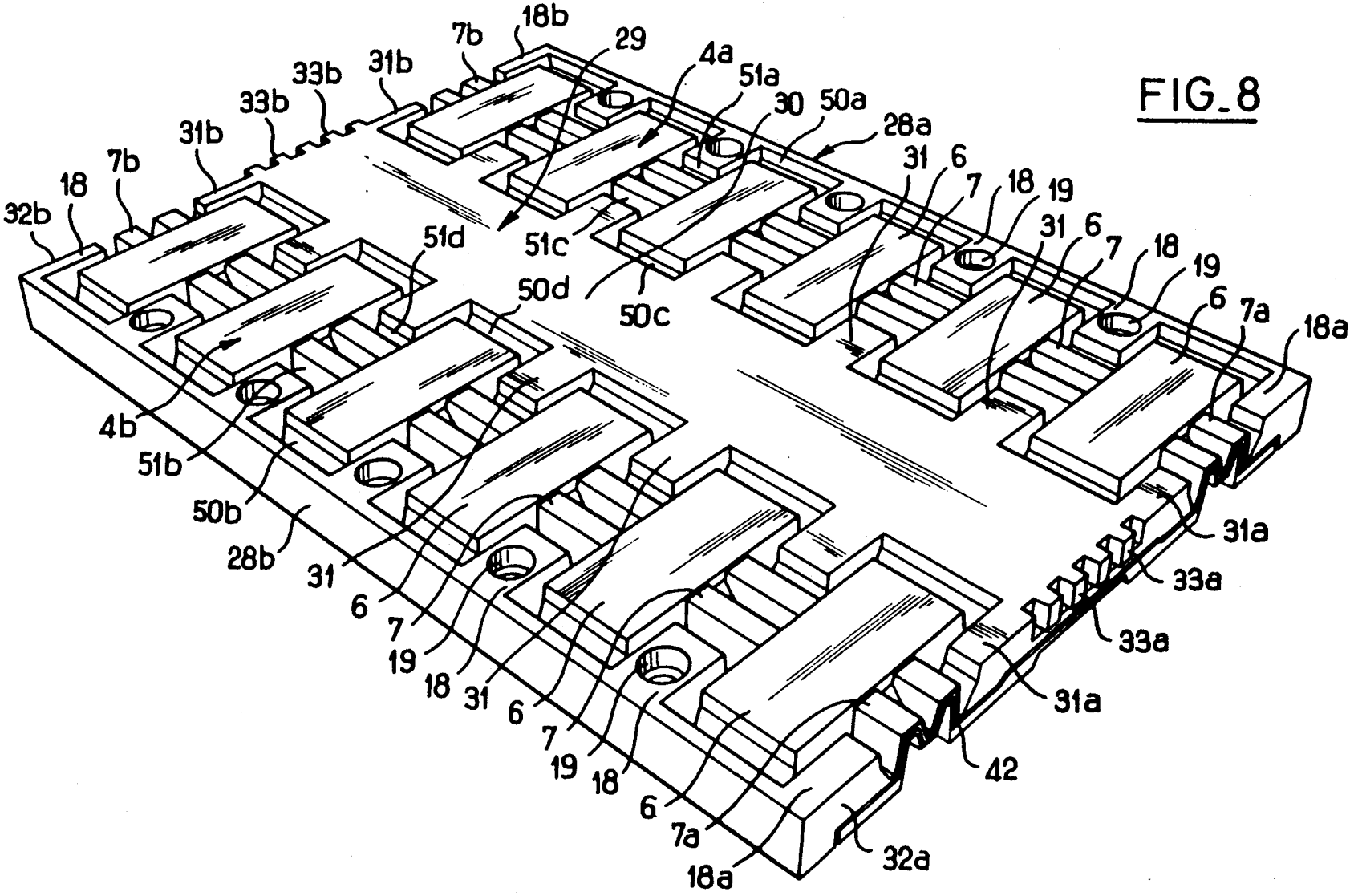
Figure 9:
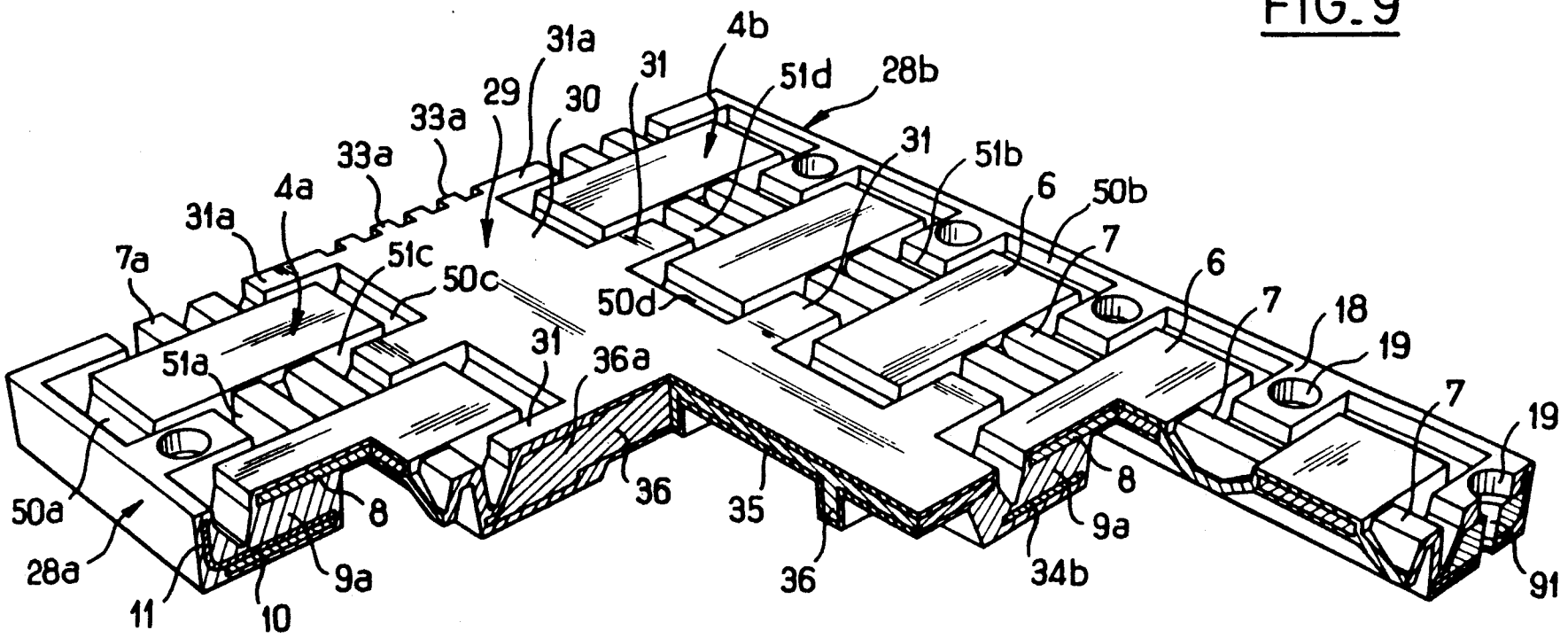
Figure 10:
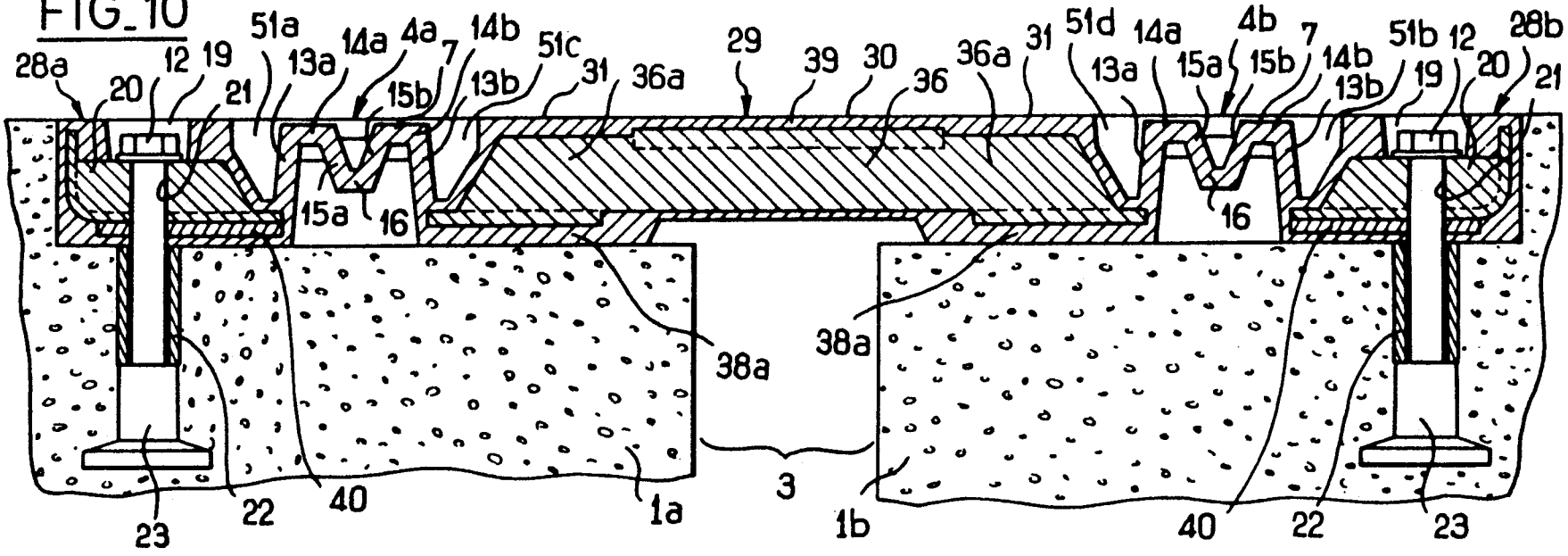
Figure 11:
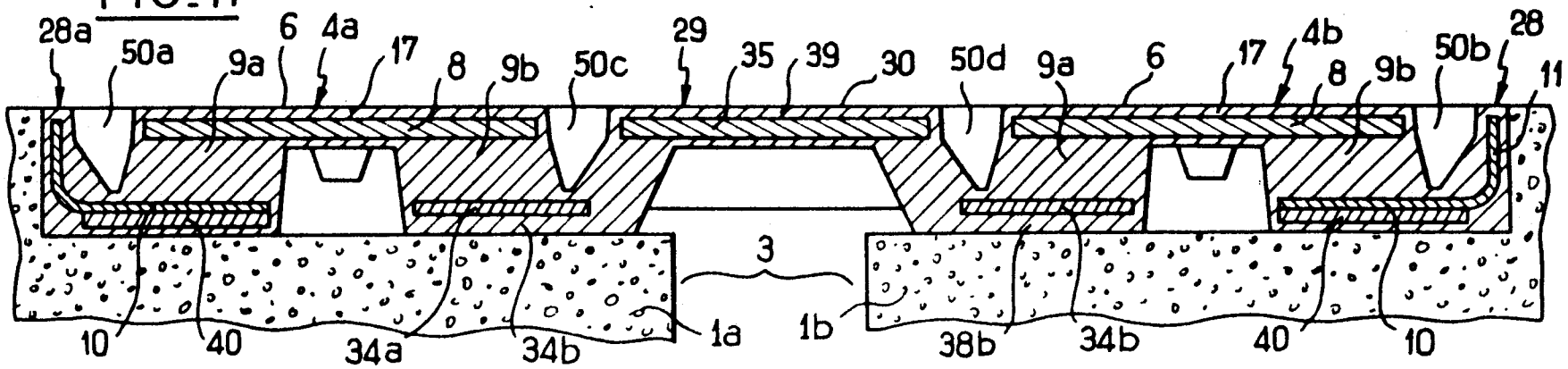
Figure 12:
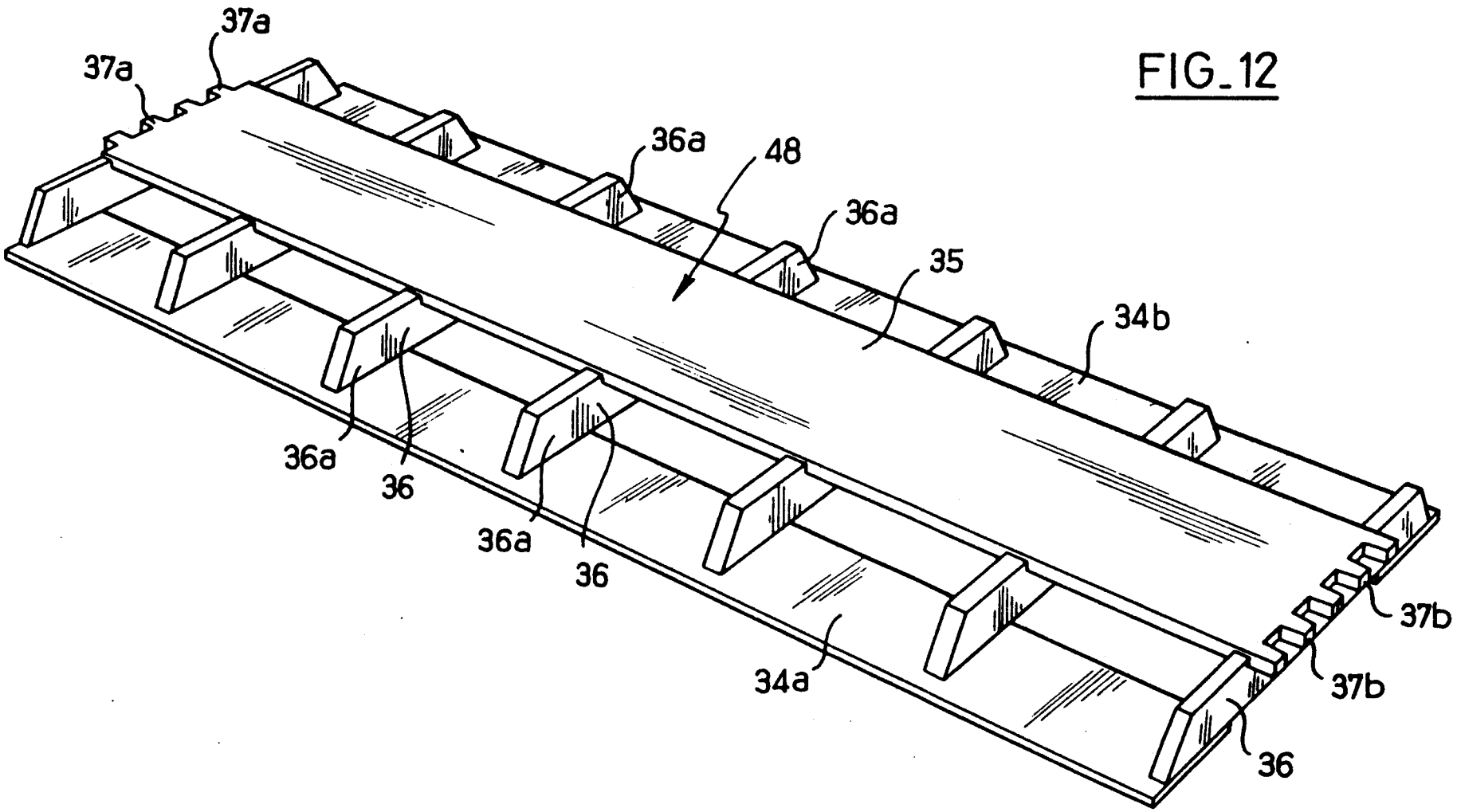
Figure 13:
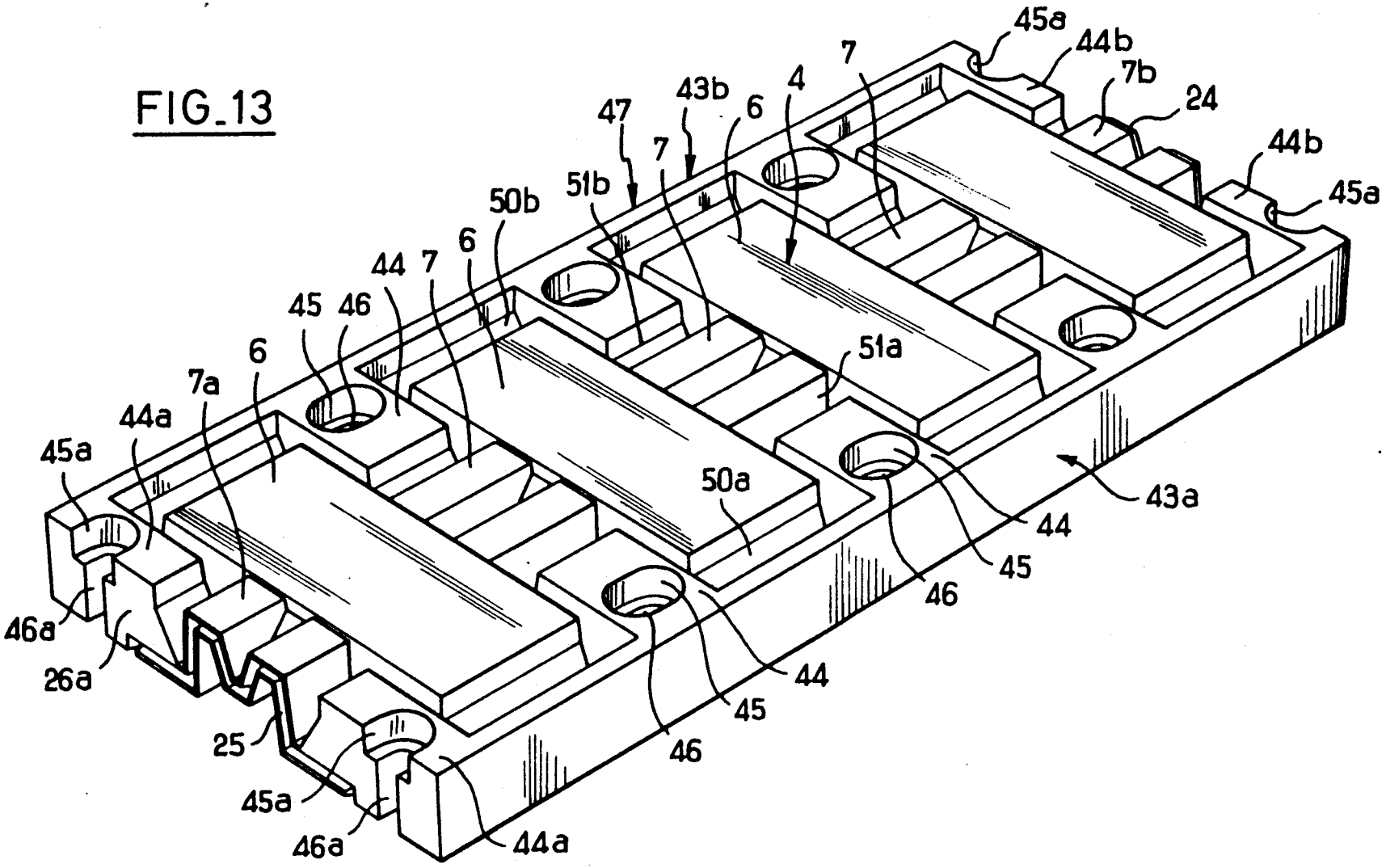

In the attached drawings, given by way of non-limiting examples:

FIG. 1 is an overall view, in perspective and partial cross-section, of an embodiment of the connection device according to the invention in which the joint strips have a single deformable zone, FIG. 2 is a perspective view of one of the joint strips in FIG. 1, FIG. 3 is a partial cross-sectional and perspective view of the connection device in FIG. 1, FIG. 4 is a view in cross-section, at the center of a bellows, of the connection device in FIG. 1, FIG. 5 is a view in cross-section, at the center of a deformable carrying element, of the connection device in FIG. 1, FIG. 6 is a perspective view of the assembly of metal pieces which are included in one of the fastening elements of the joint strip in FIG. 2, FIG. 7 is an overall view, in perspective and partial cross-section, of an embodiment of the connection device according to the invention in which the joint strips have two deformable zones situated on either side of an intermediate element, FIG. 8 is a perspective view of one of the joint strips in FIG. 7, FIG. 9 is a partial cross-sectional and perspective view of the joint strips in FIG. 8, FIG. 10 is a cross-section, situated at the center of a bellows, of the joint strip in FIG. 8, FIG. 11 is a cross-section of the joint strip in FIG. 8 situated at the center of a deformable carrying element, FIG. 12 is a perspective view of the metal piece included in the intermediate element of the joint strips in FIG. 8, FIG. 13 is a perspective view of an alternative embodiment of the joint strip according to the invention having a single deformable zone.

The connection device according to the invention shown in FIG. 1 ensures continuity of travel between the two roadway parts 1*a* and 1*b* separated by the expansion joint 3. It consists of a plurality of joint strips 2 placed end to end.

Each joint strip 2 (see FIGS. 2 to 5) has a vertical plane of symmetry parallel to the joint 3. It comprises a deformable zone 4 situated between two fastening elements 5*a* and 5*b* connected to the roadway parts 1*a* and 1*b*, respectively, by the screws 12.

The deformable zone 4 consists of deformable carrying elements 6 between which elastomeric bellows 7 are situated. The carrying elements 6 and the bellows 7 are horizontally deformable in all horizontal directions and, in particular, in the direction perpendicular to the joint 3. The length of the bellows 7, measured in this direction, is less than that of the carrying elements 6.

In the example chosen, a joint strip 2 is limited by two vertical planes perpendicular to the joint 3 and situated such that half-bellows 7a and 7b are situated at the ends of the deformable zone 4, the unit formed by two adjacent half-bellows 7a and 7b having same form as a bellows 7.

Each of the deformable carrying elements 6 (see in particular FIG. 5) has a horizontal metal plate 8 situated in the upper part of the joint strip and carried by two symmetrical elastomer blocks 9a and 9b which are deformable by horizontal shearing. The upper face of the metal plate 8 is covered with a small thickness of elastomer 17 which, in particular, ensures the protection of the said metal plate 8 against corrosion but whose presence is not essential. It can be seen, in particular in FIGS. 1 to 4, that the interconnection of the fastening elements 5a and 5b and the deformable zone 4, consisting of alternating bellows 7 and deformable carrying elements 6, consists of a recess 50a, 51a; 50b, 51b with a crenellated shape.

In a preferred embodiment, each of the elastomeric bellows 7 (see in particular FIG. 4) has, on either side of the vertical plane of symmetry, two oblique walls 15a and 15b placed between two oblique walls 13a and 13b. The walls 13a and 15a are joined, at their upper part, by a horizontal wall 14a. The walls 13b and 15b are joined, at their upper part, by a horizontal wall 14b. The walls 15a and 15b are joined, at their lower part, by a symmetrical wall 16 whose midportion is lowermost and which is inclined upwardly to its ends at the deformable carrying elements 6 which frame the bellows 7.

It is self-evident that the various walls 13a, 13b, 14a, 14b, 15a, 15b and 16 may be connected by curved wall portions without going beyond the scope of the present invention.

A fastening element 5a or 5b has undeformable carrying elements 18 in which housings 19, intended to receive the heads of the screws 12 and two ends undeformable carrying elements 18a and 18b, are provided. At the base of the fastening element 5a or 5b, a horizontal metal plate 10 is situated, bordered on the side opposite the joint 3 by a vertical metal plate 11. Above the metal plate 10 are metal reinforcements 20 which are incorporated into the undeformable carrying elements 18 and two metal reinforcements 50a which are incorporated into the end undeformable carrying elements 18a and 18b. The metal plates 10 belonging to the fastening elements 5a and 5b, respectively, form a bottom limit for and constitute the support of the elastomer blocks 9a and 9b respectively, which form part of the deformable carrying elements 6.

A fastening element 5a or 5b is made integral with the roadway parts 1a or 1b by screws 12 which traverse the metal plates 10 and the metal reinforcements 20 by pierced bores 21; the said screws 12 are insulated from the concrete by the plastic tubes 22 and are screwed into the anchorages 23 embedded in the concrete of the roadway part 1a or 1b.

FIG. 6 shows the assembly of the metal pieces 10, 11, 20 and 20a which are included in a fastening element 5a or 5b. These pieces are preferably welded to each other. They may be replaced by a single molded metal piece.

A continuous tongue 24 (see FIG. 1) projects outwards from the end 26b of each joint strip 2. It joins the lower face of the fastening element 5a to the lower face of the fastening element 5b and it follows the shape of the half-bellows 7b. A continuous groove 25 (see FIG. 2) is provided in the end 26a of each joint strip 2. It joins the lower face of the fastening element 5a to the lower face of the fastening element 5b and it follows the shape of the half-bellows 7a. When the joint strips 2 are in service, the tongue 24 and the groove 25 of two successive joint strips 2 interlock so as to ensure the tightness of the joint between the said successive joint strips 2.

It should be noted that the joint strip 2 has been selected to be described completely which is limited by two vertical planes which are perpendicular to the joint 3 and situated such that the joint strip 2 terminates in half-bellows 7a and 7b and undeformable carrying half-elements 18a and 18b. Each joint strip 2 could also be limited by two vertical planes situated such that they intersect deformable carrying elements 6 at their center.

The connection device according to the invention shown in FIG. 7 ensures continuity of travel between the two roadway parts 1a and 1b separated by the expansion joint 3. It consists of a plurality of joint strips 27 placed end to end.

One joint strip 27 (see FIGS. 7 to 11) has a vertical plane of symmetry parallel to the joint. It comprises two deformable zones 4a and 4b, each situated between a fastening element 28a or 28b and the intermediate element 29 which spans the expansion joint 3.

The deformable zones 4a and 4b are identical to the deformable zone 4 of the joint strip 2.

The plane upper face 30 of the intermediate element 29 is limited on either side of the joint 3 by a crenellated line, the projecting parts of which consist of the top of the undeformable carrying elements 31, 31a and 31b which are situated between the deformable carrying elements 6.

The deformable zone 4a is limited horizontally on the side of the fastening element 28a by the crenellated recess 50a, 51a and on the side of the intermediate element 29 by the crenellated recess 50c, 51c. The deformable zone 4b is limited horizontally on the side of the fastening element 28b by the crenellated recess 50b, 51b, and on the side of the intermediate element 29 by the crenellated recess 50d, 51d.

The intermediate element 29 has, on the side of the end 32a of the joint strip 27, teeth 33a and, on the side of the end 32b of the joint strip 27, teeth 33b designed such that, when the joint strips 27 are in service, the teeth 33a and 33b of two successive joint strips 27 interlock so as to make the ends of the intermediate elements 29 integral in their movements perpendicular to the expansion joint 3, which movements are produced in particular under the action of vehicles braking.

The metal assembly 48 incorporated into the intermediate element 29 is shown in FIG. 12 and it comprises two lower metal plates 34a and 34b and an upper metal plate 35, joined by metal bars 36.

The elastomer blocks 9b of the deformable zone 4a and the elastomer blocks 9a of the deformable zone 4b bear against the lower metal plates 34a and 34b (see in particular FIG. 11), respectively. Elastomer footings 38a and 38b, which bear against the parts 1a and 1b of the roadway, respectively, are situated beneath the lower faces of the lower metal plates 34a and 34b, respectively. The elastomer footings 38a and 38b transfer the loads sustained by the intermediate element 29 to the parts 1a and 1b of the roadway. They are relatively thick as they have to distribute the said loads even when the parts 1*a* and 1*b* of the roadway are slightly offset vertically.

The upper metal plate 35 (see FIG. 12) has, at one of its ends, teeth 37*a* and, at the other end, teeth 37*b*, and the teeth 37*a* and 37*b* are incorporated into the teeth 33*a* and 33*b*, respectively, of the intermediate element 29. The upper face of the upper metal plate 35 (see in particular FIGS. 10 and 11) is covered with a small thickness of elastomer 39 which, in particular, ensures the protection of the said upper metal plate 35 against corrosion but whose presence is not essential.

The ends 36*a* of the metal bars are incorporated into the undeformable carrying elements 31, 31*a*, 31*b* which they reinforce.

The fastening elements 28*a* and 28*b* of the joint strip 27 are identical to the fastening elements 5*a* and 5*b* of the joint strip 2 with the exception that a lining 40 has been placed beneath the horizontal metal plates 10 (see in particular FIGS. 10 and 11) such that the upper faces of the horizontal metal plates 10 and of the horizontal metal plates 34*a* and 34*b* are at the same level so as to preserve the symmetry of the pairs of elastomer blocks 9*a* and 9*b* which are deformable by shearing. This symmetry is the condition for the intermediate element 29 not to tend to rise when the expansion joint 3 opens or closes.

A continuous tongue 41 (see FIG. 7) projects outwards from the end 32*b* of each joint strip 27. It joins the lower face of the fastening element 28*a* to the lower face of the fastening element 28*b*, following the shape of the half-bellows 7*b* and passing beneath the teeth 37*b*. A continuous groove 42 (see FIG. 8) is provided at the end 32*a* of each joint strip 27. It reproduces, recessed, the shape of the tongue 41. When the joint strips 27 are in service, the tongue 41 and the groove 42 of two successive joint strips 27 interlock so as to ensure the tightness of the join between the said successive joint strips 27.

The joint strip 27 has been chosen to be described completely which is limited by two vertical planes which are perpendicular to the joint 3 and situated such that the joint strip 27 terminates in half-bellows 7*a* and 7*b* and undeformable carrying half-elements 18*a*, 18*b*, 31*a* and 31*b*. Each joint strip 27 could also be limited by two vertical planes situated such that it is the deformable carrying elements 6 which are intersected at their center.

The joint strips 2 and 27 have been chosen to be shown which are completely coated with elastomer, which ensures an optimum protection of the metal pieces against corrosion. In the case of the joint strip 2, each of the fastening elements 5*a* or 5*b* could consist of a single piece of a metal with a low sensitivity to corrosion such as an aluminum-based alloy, the only elastomeric parts then being those which form the deformable zone 4, in other words the deformable carrying elements 6 and the bellows 7, 7*a* and 7*b*. Similarly, in the case of the joint strip 27, the fastening elements 28*a* or 28*b*, as well as the intermediate element 29, with the exception of the elastomer footings 38*a* and 38*b*, could be formed by pieces of a metal with a low sensitivity to corrosion, the only elastomeric parts then being the elastomer footings 38*a* and 38*b*, the deformable carrying elements 6 and the bellows 7, 7*a* and 7*b*.

The joint strip 47 shown in FIG. 13 has a single deformable zone 4. It differs from the joint strip 2 shown in FIGS. 1 to 6 in the design of the fastening elements 43*a* and 43*b*.

Indeed, the housings 45 and the pierced bores 46 intended to receive the heads and the shanks, respectively, of the screws 12 provided in the standard undeformable carrying elements 44, are oblong, in other words, they are elongated in the direction parallel to the expansion joint, the object being to facilitate the accurate positioning of the joint strips 47.

Furthermore, housings 45*a* and grooves 46*a* are provided in the end undeformable carrying elements 44*a* and 44*b* and have shapes such that, when the joint strips 47 are mounted, the unit formed by two attached undeformable carrying elements 44*a* and 44*b* belonging to two neighboring joint strips 47 has same shape as a standard undeformable carrying element 44, which enables the screws 12 to be positioned, bearing against two neighboring joint strips 47.

The invention is not, of course, limited to the exemplary embodiments which have just been described and numerous modifications may be made to them without going beyond the scope of the invention.

I claim:

1. Device for the interconnection of two roadway parts (1*a*, 1*b*) separated by an expansion joint (3) consisting of a plurality of joint strips (2, 27, 47) arranged end to end and in which each joint strip (2, 27, 47) comprises at least one deformable zone (4, 4*a*, 4*b*) extending parallel to the joint (3), between two fastening elements (5*a* and 5*b*, 28*a* and 28*b*, 43*a* and 43*b*) connected to the two roadways parts (la, 1*b*) respectively, characterized in that this deformable zone (4, 4*a*, 4*b*) consists of alternating carrying elements (6) and bellows (7), which are deformable in all horizontal directions, the length of the bellows, measured in the direction perpendicular to the joint (3), being less than that on either side of each bellows (7), of the deformable carrying elements, and in that, on either side of each bellows (7), two undeformable carrying elements (18, 18*a*, 18*b*, 31, 31*a*, 31*b*, 44, 44*a*, 44*b*) are situated, these undeformable carrying elements extending in a direction transverse to the joint (3) in the space between two deformable carrying elements (6), each of the deformable carrying elements (6) having a horizontal metal plate (8) situated in the upper part of the joint strip (2, 27, 47) and carried by two elastomer blocks (9*a*, 9*b*) which are deformable by horizontal shearing and arranged symmetrically relative to a vertical plane parallel to the joint (3), each of the bellows (6) consisting of an elastomeric, continuous, relatively thin and non-plane wall.

2. Connection device according to claim 1, characterized in that the deformable zone, (4, 4*a*, 4*b*), consisting of alternating deformable carrying elements (6) and bellows (7) is limited horizontally by two recesses (50*a*, 51*a*; 50*b*, 51*b*; 50*c*, 51*c*; 50*d*, 51*d*) with a crenellated shape.

3. Connection device according to claim 1, characterized in that each of the fastening elements (5*a*, 5*b*, 28*a*, 28*b*, 43*a*, 43*b*) has, in its lower part, a substantially plane metal plate (10) on which the undeformable carrying elements (18, 18*a*, 18*b*, 31, 31*a*, 31*b*, 44, 44*a*, 44*b*) bear, as well as the elastomer blocks (9*a*, 9*b*) which are deformable by horizontal shearing and are situated above it, which metal plate is traversed by the screws (12) for making the fastening blocks (5*a*, 5*b*, 28*a*, 28*b*, 43*a* 43*b*) integral with the corresponding part of the roadway (1*a* 1*b*), the said screws (12) preferably being situated perpendicular to undeformable carrying elements (18, 31, 44, 44*a*, 44*b*).

4. Connection device according to claim 3, characterized in that each of the fastening elements (5*a*, 5*b*, 28*a*, 28*b*, 43*a*, 43*b*) has, above the lower plane metal plate (10) incorporated into these elements, metal reinforcements (20) on which the screws (12) for making the fastening blocks (5*a*, 5*b*, 28*a*, 28*b*, 43*a*, 43*b*) integral with the corresponding part of the roadway (1*a*, 1*b*) bear.

5. Connection device according to claim 1, characterized in that each of the joint strip (2, 47) has a single deformable zone (4) situated substantially at right angles to the expansion joint (3).

6. Connection device according to claim 1, characterized in that each of the joint strip (27) has two deformable zones (4*a*, 4*b*) situated on either side of the expansion joint (3) and between which an intermediate element (29) is situated, spanning the expansion joint (3) and which bears on either side of the latter, and in that the plane upper face (30) of the said intermediate element (29) is extended, on either side of the joint, by undeformable carrying elements (31, 31*a*, 31*b*).

7. Connection device according to claim 6, characterized in that the intermediate element (29) has, on either side of it, in its lower part, two plane metal plates (34*a*, 34*b*) on which the elastomer blocks (9*a*, 9*b*), deformable by horizontal shearing and situated above them, bear, as well as undeformable carrying elements (31, 31*a*, 31*b*).

8. Connection device according to claim 7, characterized in that the intermediate element (29) is reinforced by metal bars (36) which bear against the lower metal plates (34*a*, 34*b*) and which support a metal plate (35) situated close to the upper face of the said intermediate element (29).

9. Connection device according to claim 7, characterized in that the intermediate element (29) has, at its ends situated above the expansion joint (3), teeth (33*a*, 33*b*) arranged such that the teeth (33*a*, 33*b*) belonging to two successive joint strips (27) interlock.

10. Connection device according to claim 1, characterized in that each joint strip (2, 27, 47) has, at one of its ends, (26*b*, 32*b*) which is situated above the expansion joint (3), a continuous tongue (24, 41) ranging from the bearing surface of one of the fastening elements (5*a*, 28*a*, 43*a*) to the bearing surface of the other fastening element (5*b*, 28*b*, 43*b*) and, at the opposite end (26*b*, 32*b*), a groove (25, 42) with the same shape, the groove (25, 42) and the tongue (24, 41) belonging to two neighboring joint strips (2, 27, 47), respectively, interlocking in order to ensure the continuity of the tightness of the device.

11. Connection device according to claim 1, characterized in that each bellows (7) is symmetrical relative to a vertical plane and has, on each side of this vertical plane of symmetry and moving closer to the said plane, a rising wall (14*a*, 14*b*) joined to a descending wall (15*a*, 15*b*) whose width decreases close to the adjacent deformable carrying elements (6).

* * * * *